US007950833B1

(12) United States Patent
Crane et al.

(10) Patent No.: US 7,950,833 B1
(45) Date of Patent: May 31, 2011

(54) SPLAY FRAME LUMINAIRE

(75) Inventors: Roy B. Crane, Wilmington, MA (US); William Fabbri, Barnstead, NH (US)

(73) Assignee: Genlyte Thomas Group LLC, Louisville, KY (US)

( * ) Notice: Subject to any disclaimer, the term of this patent is extended or adjusted under 35 U.S.C. 154(b) by 382 days.

(21) Appl. No.: 12/140,520

(22) Filed: Jun. 17, 2008

(51) Int. Cl.
*F21S 8/06* (2006.01)

(52) U.S. Cl. ..... 362/404; 362/405; 362/319; 362/320; 362/368

(58) Field of Classification Search ..... 362/147, 362/368, 427, 287, 364, 319, 320
See application file for complete search history.

(56) References Cited

U.S. PATENT DOCUMENTS

| | | | | |
|---|---|---|---|---|
| RE17,825 | E | 10/1930 | Linton | |
| 2,800,965 | A | 7/1957 | Church | |
| 2,817,752 | A | 12/1957 | Florence | |
| 2,875,323 | A | 2/1959 | Harling | |
| 2,988,633 | A | 6/1961 | Rosenfield | |
| 2,990,470 | A | 6/1961 | Bodian | |
| 2,998,508 | A | 8/1961 | Bobrick | |
| 3,052,372 | A | 9/1962 | Shepherd | |
| 3,097,903 | A | 7/1963 | Moore | |
| 3,099,403 | A | 7/1963 | Strawick | |
| 3,158,327 | A | 11/1964 | Dameral | |
| D203,692 | S | 2/1966 | Roovaart | |
| 3,246,137 | A | 4/1966 | Zagel | |
| 3,299,264 | A | 1/1967 | Libscomb | |
| D208,099 | S | 7/1967 | Arrigoni | |
| 3,349,237 | A | 10/1967 | Jackson | |
| 3,351,409 | A | 11/1967 | McGuire | |
| 3,375,361 | A | 3/1968 | Thompson | |
| 3,384,743 | A | 5/1968 | Little | |
| 3,426,312 | A | 2/1969 | Gerald | |
| 3,428,799 | A | 2/1969 | Bassani | |
| 3,483,366 | A | 12/1969 | Wince | |
| 3,524,050 | A | 8/1970 | Gustine | |
| 3,532,876 | A | 10/1970 | Muller | |
| 3,557,359 | A | 1/1971 | Meyer | |
| 3,671,739 | A * | 6/1972 | McCain | 362/295 |
| 3,679,893 | A | 7/1972 | Shemitz | |
| 3,685,003 | A | 8/1972 | Watt | |
| 3,687,055 | A | 8/1972 | Dean | |
| 3,701,895 | A | 10/1972 | Sweetser | |
| 3,701,898 | A | 10/1972 | McNamara | |
| 3,721,818 | A | 3/1973 | Stahlhut | |
| 3,780,286 | A | 12/1973 | Alexieff | |
| 3,832,540 | A | 8/1974 | Roth | |
| 3,902,059 | A | 8/1975 | McNamara | |
| 3,909,100 | A | 9/1975 | Hodge | |
| 3,911,265 | A | 10/1975 | Landrum | |
| 3,928,757 | A | 12/1975 | Nelson | |
| 3,949,214 | A | 4/1976 | Jones | |
| 3,988,609 | A | 10/1976 | Lewin | |
| 4,001,571 | A | 1/1977 | Martin | |
| 4,054,793 | A | 10/1977 | Shemitz | |
| 4,065,667 | A | 12/1977 | Ruud | |
| 4,070,570 | A | 1/1978 | Wetmore | |

(Continued)

*Primary Examiner* — Ali Alavi

(57) ABSTRACT

A fluorescent luminaire has a luminaire housing, a lens frame positioned within the luminaire housing, the lens frame having a first side frame member and a second side frame member connected to a first end frame member and a second end frame member, a flexible plastic lens having a length, wherein a distance between the first and second side frames is less than the length of the plastic lens and, wherein the lens curves from the flat orientation to a curved orientation when seated between the first and second side frames corresponding to curvature of the first and second end frames.

28 Claims, 13 Drawing Sheets

U.S. PATENT DOCUMENTS 4,080,978 A 3/1978 McCabe
4,128,333 A 12/1978 Levin et al.
4,153,929 A 5/1979 Laudenschlarger
4,157,585 A * 6/1979 Freeman ..... 362/248
RE30,204 E 2/1980 Root
4,198,108 A 4/1980 Bassetto
4,204,274 A 5/1980 Luderitz
4,233,651 A 11/1980 Fabbri
4,263,930 A 4/1981 McCabe
4,277,820 A 7/1981 Bostonian
4,288,846 A 9/1981 Fletcher
4,300,185 A 11/1981 Wakamatsu
4,308,573 A 12/1981 McNamara
4,322,783 A 3/1982 Chappell
4,323,953 A 4/1982 Hutchison
4,338,653 A 7/1982 Marrero
4,368,504 A 1/1983 Sata
4,388,675 A 6/1983 Lewin
4,415,957 A 11/1983 Schwartz
4,422,712 A 12/1983 Koszytorz
4,432,044 A 2/1984 Lautzenheiser
4,498,126 A 2/1985 Hernandez
4,533,851 A 8/1985 Block
4,536,832 A 8/1985 Lemons
4,542,947 A 9/1985 Flor
4,562,515 A 12/1985 Lautzenheiser
4,597,035 A 6/1986 Lettenmeyer
D286,206 S 10/1986 Joosten
4,627,498 A 12/1986 Aalto
4,636,841 A 1/1987 Moles
4,722,039 A 1/1988 Gaugel
4,726,781 A 2/1988 Bernhart
4,744,767 A 5/1988 Henrici
4,747,027 A 5/1988 Rieger
4,748,547 A 5/1988 Baker
4,760,505 A 7/1988 Cole
4,796,168 A 1/1989 Peterson
4,803,600 A 2/1989 Pepping
4,842,535 A 6/1989 Velke
4,849,864 A 7/1989 Forrest
4,866,583 A 9/1989 Targetti
4,866,584 A 9/1989 Plewman
4,876,633 A 10/1989 Engel
4,891,737 A 1/1990 Szymanek
4,924,368 A 5/1990 Northrop
4,928,209 A 5/1990 Rodin
4,933,820 A 6/1990 Engel
4,939,627 A 7/1990 Herst
4,958,687 A 9/1990 Nakagawa
4,975,812 A 12/1990 Cole
4,980,808 A 12/1990 Lilos
5,006,970 A 4/1991 Mackiewicz
5,038,254 A 8/1991 Fabbri
5,086,375 A 2/1992 Fabbri
5,109,323 A 4/1992 Waycaster
5,113,328 A 5/1992 Foster
5,124,896 A 6/1992 Bentley
5,160,193 A 11/1992 Fabbri
5,199,786 A 4/1993 Baliozian
5,226,724 A 7/1993 Kanarek
5,272,607 A 12/1993 Grimm
5,272,608 A 12/1993 Engle
5,291,379 A 3/1994 Lu
5,301,092 A * 4/1994 Santosuosso et al. ..... 362/125
5,343,373 A 8/1994 Tillotson
5,371,661 A 12/1994 Simpson
5,436,816 A 7/1995 Nagano
5,440,466 A 8/1995 Belisle
5,479,327 A 12/1995 Chen
5,493,482 A 2/1996 Bowen
5,521,805 A 5/1996 Lim
5,536,998 A 7/1996 Sica
5,570,947 A 11/1996 Felland
5,658,066 A 8/1997 Hirsch
5,658,067 A 8/1997 Engle
5,702,176 A 12/1997 Engle
5,716,123 A 2/1998 Lamming
5,727,870 A 3/1998 Grierson
5,746,502 A 5/1998 Huang
5,800,050 A 9/1998 Leadford
5,806,967 A 9/1998 Soorus
5,865,528 A 2/1999 Compton
5,884,994 A 3/1999 Herst
D409,325 S * 5/1999 Holder et al. ..... D26/74
5,988,829 A 11/1999 Holder
5,988,836 A 11/1999 Swarens
6,152,573 A * 11/2000 Mitchell ..... 362/223
6,155,921 A 12/2000 Evans
6,186,642 B1 2/2001 Corcorran
6,193,394 B1 2/2001 Herst
6,203,421 B1 3/2001 Black
6,247,828 B1 6/2001 Herst
6,305,816 B1 10/2001 Corcorran
6,402,345 B1 6/2002 Fishman
6,422,721 B1 6/2002 Plunk
D460,575 S 7/2002 Tergny
6,505,953 B1 1/2003 Dahlen
6,523,974 B2 2/2003 Engel
6,530,674 B2 3/2003 Grierson
6,568,830 B2 5/2003 Yaphe
D477,891 S 7/2003 Fritze
6,634,772 B2 10/2003 Yaphe
6,652,113 B2 * 11/2003 Tant ..... 362/147
6,655,819 B2 12/2003 Loga
6,733,154 B1 5/2004 Dahlen
6,746,325 B2 6/2004 Crane
D496,121 S 9/2004 Santoro
6,817,732 B1 11/2004 Knoble
6,863,420 B1 3/2005 Schutz
7,055,982 B2 6/2006 Yaphe
7,204,603 B1 4/2007 Lanczy
D545,482 S 6/2007 Mayfield
D545,483 S 6/2007 Mayfield
D545,992 S 7/2007 Mayfield
D545,993 S 7/2007 Mayfield
D556,358 S 11/2007 Santoro
D561,383 S 2/2008 Hukle
2002/0003698 A1 1/2002 Engel
2006/0198134 A1 * 9/2006 Fowler, Jr. ..... 362/217

* cited by examiner

SPLAY FRAME LUMINAIRE

TECHNICAL FIELD

This invention is related to fluorescent luminaires. More specifically, the invention is related to a fluorescent luminaire with a normally flat flexible lens which conforms to a curvature of a lens frame.

BACKGROUND

Lighting can be commonly provided by fluorescent lighting systems. These systems are capable of illuminating surfaces with a desirable brightness level necessary for productivity.

Fluorescent luminaires typically have a housing, and a lens positioned within an opening of housing. The lens is typically flat extending across the housing opening. Some fluorescent luminaires provide curved diffusers or lenses for use in these applications. However, to provide a curved lens, the lens is typically extruded or vacuum formed into a curved shape for installation. Extrusion and vacuum forming processes cost more than flat lenses.

It would be desirable to create a soft and appealing lighting environment while maintaining productive light levels at a reasonable cost. Further, it would be desirable to have a lens which is curved but less expensive to form than prior art lenses.

SUMMARY

A fluorescent luminaire comprises a luminaire housing, a lens frame positioned within the luminaire housing, the lens frame having a first side frame member and a second side frame member connected to a first end frame member and a second end frame member, a flexible plastic lens having a length, wherein a distance between the first and second side frames is less than the length of the plastic lens and, wherein the lens curves from the flat orientation to a curved orientation when seated between the first and second side frames corresponding to curvature of the first and second end frames. The fluorescent luminaire wherein the first end frame member and the second end frame member each having a curved upper edge. The fluorescent luminaire wherein the lens is positioned against the curved edges of the first and second end frame members. The fluorescent luminaire wherein the first and second side frame members having a shoulder wherein the lens is seated. The fluorescent luminaire wherein the lens is convex curved. The fluorescent luminaire wherein the lens is seated within the lens frame and extends from a first end of the luminaire to a second end of the luminaire and from a first side to a second side. The fluorescent luminaire wherein the first and second end frame members are disposed at an angle from the vertical. The fluorescent luminaire wherein the first and second side frame members are disposed at an angle from the vertical. The fluorescent luminaire wherein the side members have shoulders along an edge. The fluorescent luminaire wherein the side members are angled. The fluorescent luminaire wherein an upper portion of the shoulders captures the lens.

The fluorescent luminaire comprises a fluorescent housing having preselected opening shape, a first side frame member and an opposed side frame member connected to a first end frame member and a second end frame member, the side frame members and the end frame members defining a lens frame within the fluorescent housing, each of the end frame members having a curved upper edge and a lens seated therein, the lens extending between the side frame members and the end frame members and, wherein the lens is flat and flexibly seated within the curved portion to conform to the curvature of the curved portion. The fluorescent luminaire wherein the end frame members are disposed at an angle. The fluorescent luminaire wherein the side frame members are disposed at an angle. The fluorescent luminaire further comprising a bar extending along an edge of the troffer body. The fluorescent luminaire wherein the end frame members further comprising a leg portion along a lower edge of the end body members. The fluorescent luminaire wherein side frame members having slots for receiving tabs extending from the end body members. The fluorescent luminaire further comprising a leg along lower edges of the side frame members and the end frame members. The troffer wherein the body has a lower opening and the lens has a convex curvature. The fluorescent luminaire wherein one of the first and second side frame members and the first and second end frame members has a shoulder for seating opposed edges of the lens and maintaining a curvature of the lens.

A luminaire comprises a housing having opposed ends, opposed sides, an upper wall and a lower opening, opposed side members disposed within the housing adjacent the opposed sides, opposed end members connected to the opposed side members, the opposed end members having a curved edge and, wherein a lens extends between the opposed side members and is seated against the curved edge. The luminaire wherein the lens is formed of a flexible material. The luminaire has a convex curvature. The luminaire further comprising a rear reflector within the housing and above the lens. The luminaire wherein the housing is positioned in a suspended ceiling structure. The luminaire wherein the suspended ceiling structure formed of inverted T-grid members extending longitudinally and latitudinally. The luminaire wherein the opposed side members and the opposed end members defining a lens frame. The luminaire wherein the lens frame is hingedly connected to the housing.

A method of positioning a lens within a luminaire housing comprises forming a luminaire housing, forming a lens frame, positioning the lens frame within the luminaire housing, positioning a flat lens in the lens frame and, bending the flat lens into a curved configuration wherein the frame retains the lens in the curved configuration. The method further comprises using a spring force created by the bending of the lens to retain the lens in position in the lens frame. The method further comprises hingedly positioning the lens frame and the luminaire housing. The method further comprises latching the lens frame in a closed position within the luminaire housing. The method further comprises forming the lens frame of at least two opposed members having a curvilinear edge.

A method of forming a luminaire comprises forming a luminaire housing, forming a lens frame, positioning a flat lens in the lens frame, bending the flat lens into a curved configuration wherein the frame retains the lens in the curved configuration and, positioning the lens frame within the luminaire housing. The method further comprising using a spring force created by the bending of the lens to retain the lens in position within the lens frame. The method further comprising hingedly positioning the lens frame and the luminaire housing. The method further comprising latching the lens frame in a closed position within the luminaire housing. The method of further comprising forming the lens frame of at least of at least two opposed members having a curvilinear edge.

BRIEF DESCRIPTION OF THE ILLUSTRATIONS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
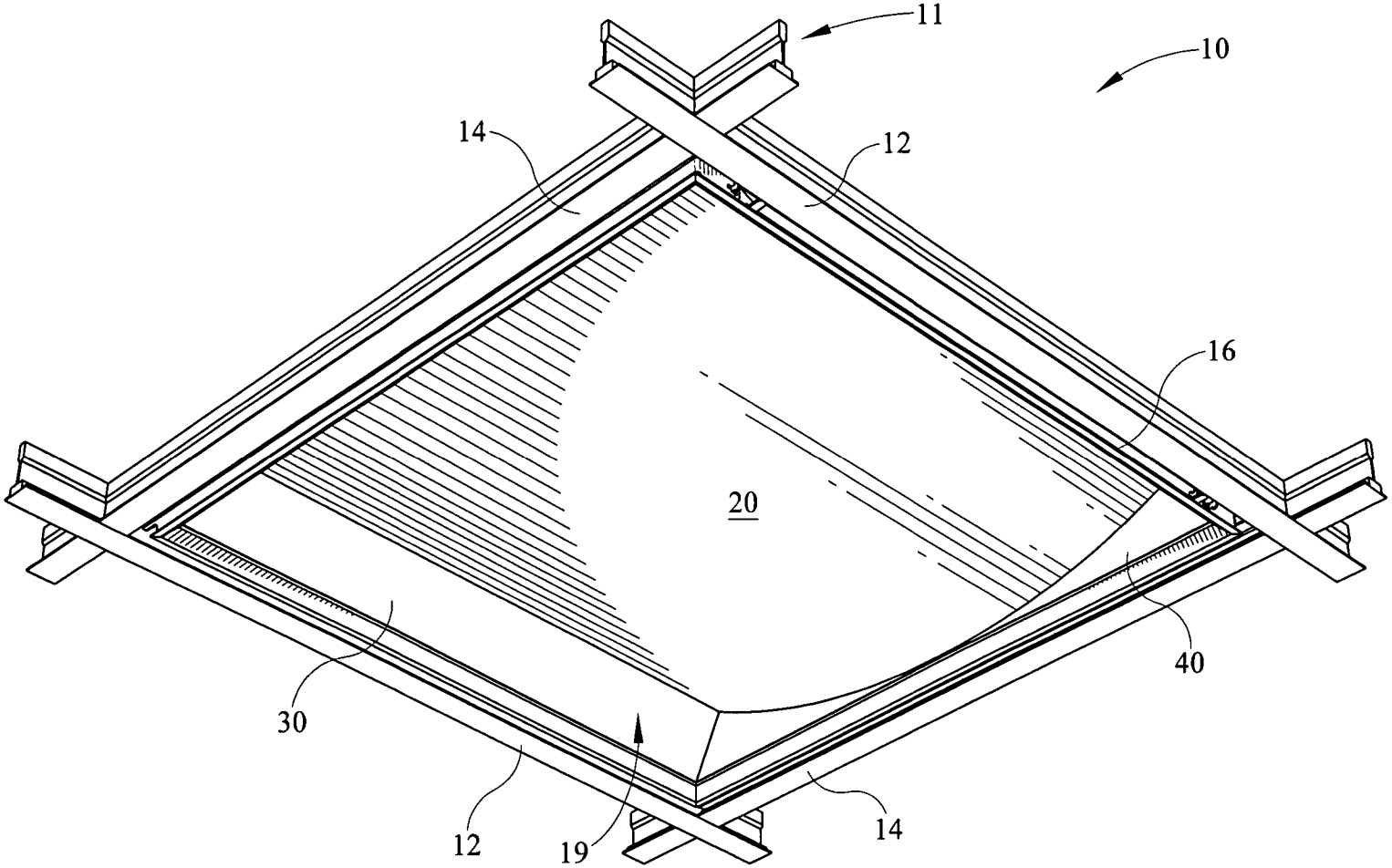
FIG. 1 depicts a lower perspective view of a fluorescent luminaire.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The splay frame luminaire utilizes a lens frame within the housing in order to retain a normally relaxed flat lens in a curvilinear shape without requiring the lens be formed in a more expensive manner, such as by extrusion or vacuum forming.

Referring now to FIG. 1, a lower perspective view of a fluorescent luminaire splay frame assembly 10 is depicted. The luminaire assembly 10 is positioned within a suspended ceiling 11 defined by longitudinal and latitudinal ceiling members 12, 14. The terms longitudinal and latitudinal are simply utilized to distinguish between the grid members which extend in perpendicular directions, but should not be considered limiting, wherein the term longitudinal corresponds to the direction a lamp tube extends through the luminaire 10. The ceiling member 12, 14 are depicted as inverted T-grid structures, however slotted T-grid or other ceiling structures may be utilized. Each intersection of the longitudinal ceiling members 12 and latitudinal ceiling member 14 defines a corner of an opening 19 wherein a troffer body 16 is positioned. Although a troffer body or housing is depicted, the luminaire is not limited to a troffer type luminaire.

Within the housing 16, a lens 20 is depicted. The lens 20 is formed of plastic material. For example, the lens 20 may be formed of polycarbonate, acrylic, or like flexible material. Additionally, the lens 20 may have one prismatic surface or two surfaces for controlling dispersion of light. The flexible lens 20 is formed flat, however the flexibility allows the lens to conform to the shape of the curved edge of the end members 40. The convex shaped lens 20 is depicted within the troffer body 16 extending between the side members 30, 32 and between the end members 40, 42.

Figure 2:
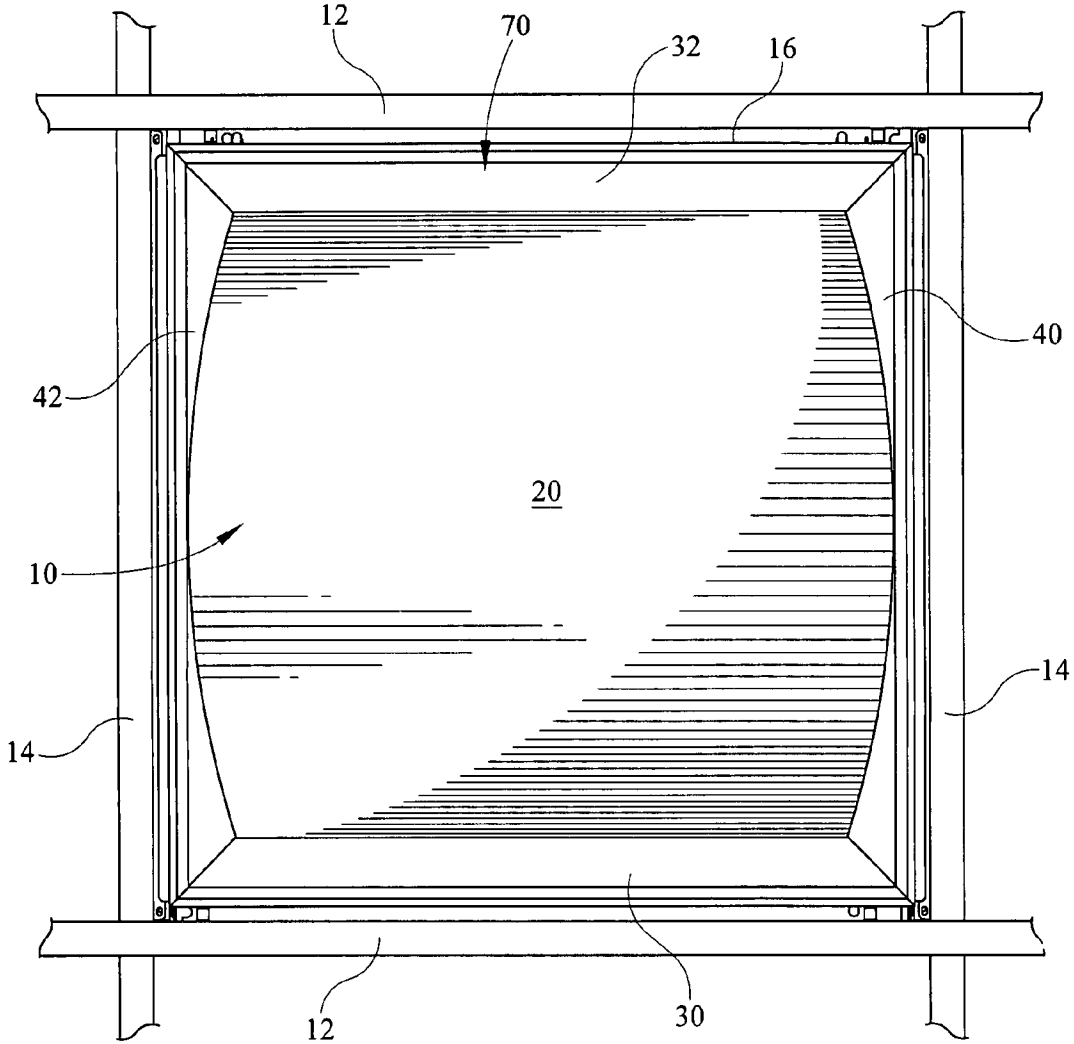
FIG. 2 depicts a bottom view of the fluorescent luminaire of FIG. 1.

Referring now to FIG. 2, a bottom view of the fluorescent luminaire assembly 10 is depicted. The assembly 10 is bounded by the longitudinal ceiling members 12 and the latitudinal ceiling members 14. The members 12, 14 define an opening wherein the luminaire assembly 10 is positioned. The opening defined by the members 12, 14 is square in shape corresponding to a preselected housing 16 shape, for example, 2'×2' troffer. However, other preselected sizes and shapes may be used such as 1'×4' and 2'×4', and the like.

Also shown in FIG. 2, is the lens frame 70. The lens frame 70 is seated within the luminaire housing 16. The lens 20 is seated in a frame 70 defined by first and second side frame members 30, 32 and first and second end members 40, 42. The innermost surfaces of the members 30, 32, 40, 42 are angled with respect to a vertical plane.

Figure 3:
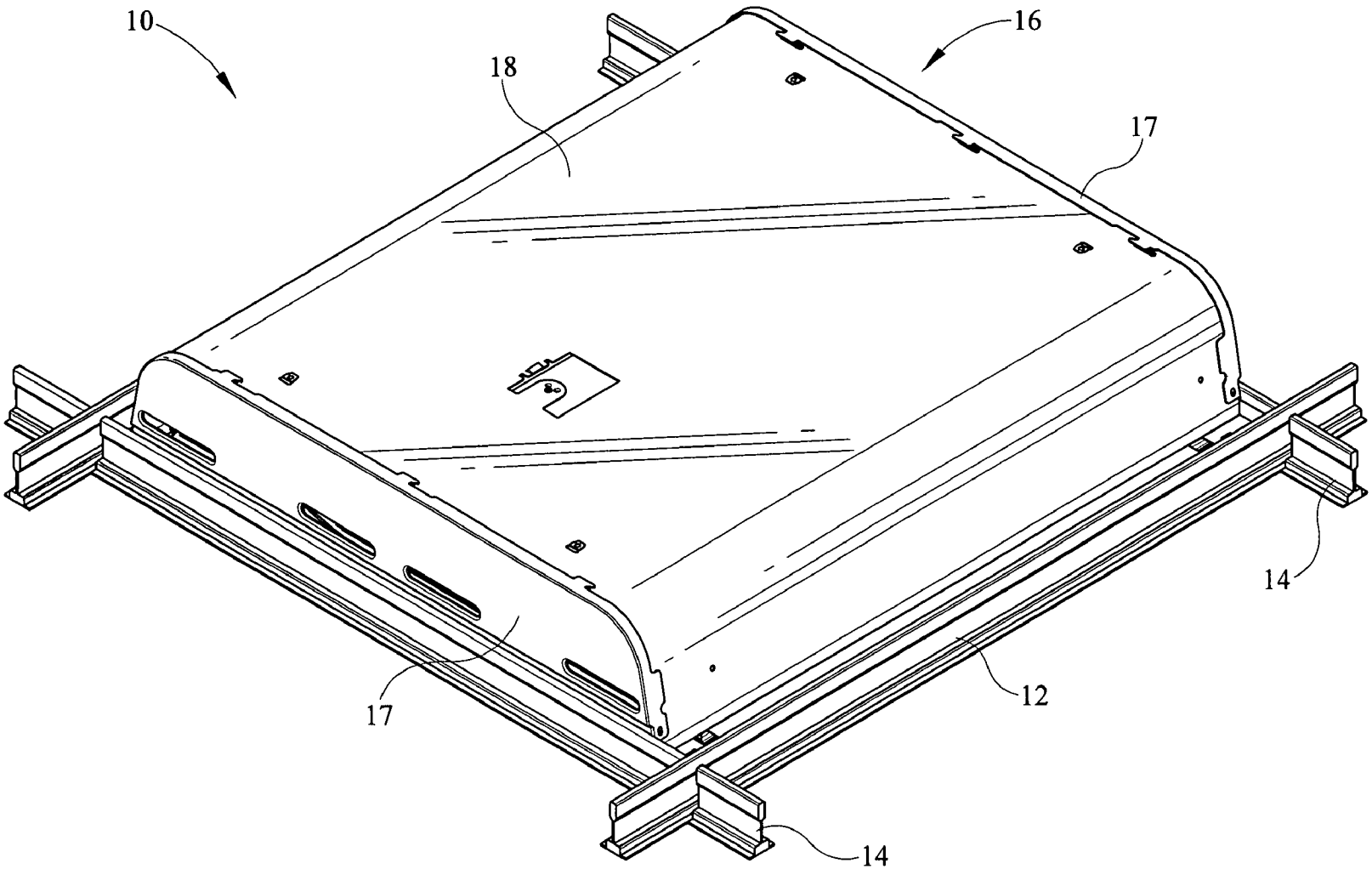
FIG. 3 depicts an upper perspective view of the fluorescent luminaire of FIG. 1.
Figure 4:
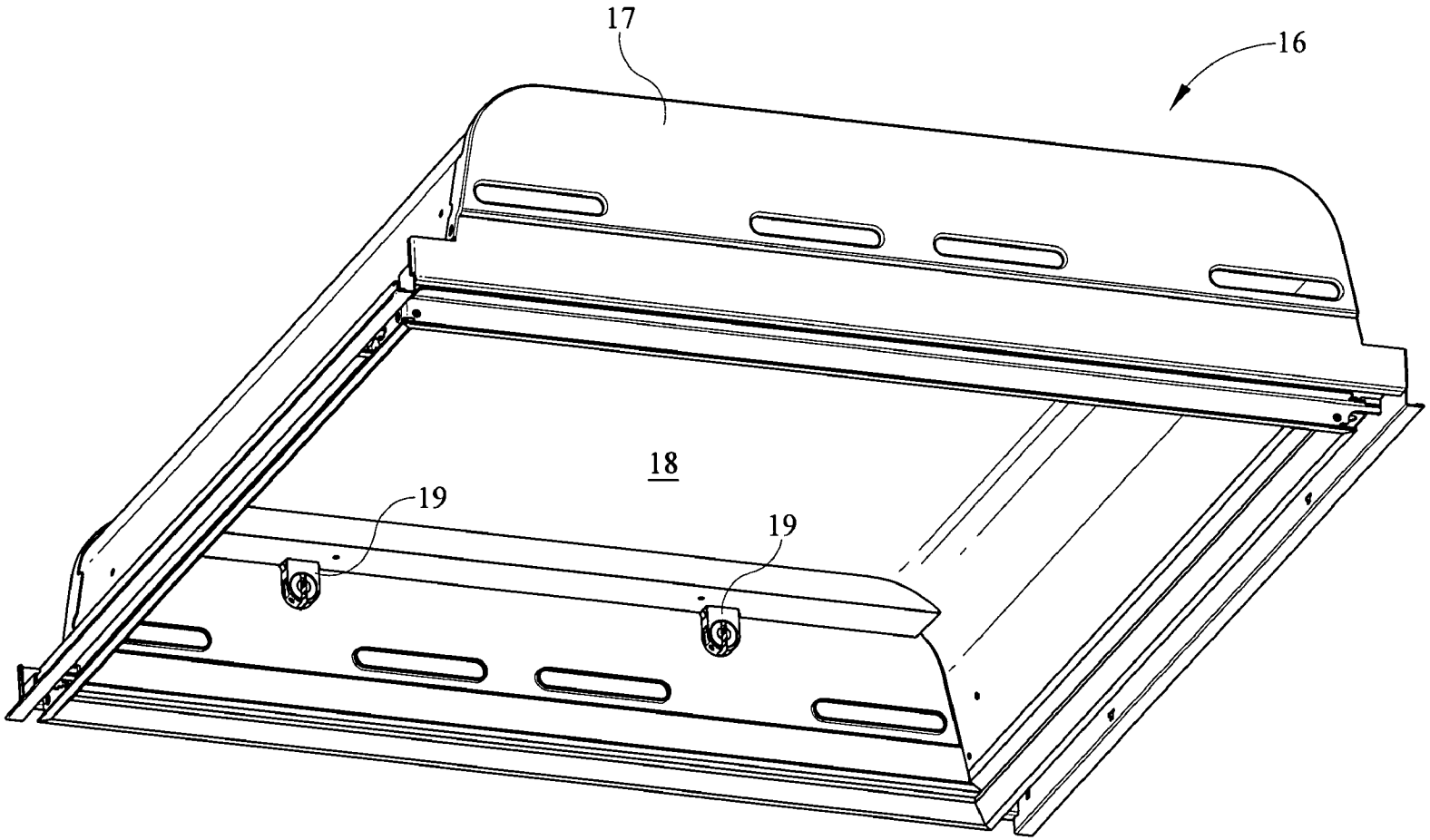
FIG. 4 depicts a lower perspective view of fluorescent luminaire of FIG. 1 with the lens and lens frame removed.

Referring now to FIG. 3, the splay frame luminaire assembly 10 is depicted in an upper perspective view. The luminaire assembly 10 comprises the housing 16 which has an upper or top wall 18 which curves downwardly at sides of the fixture 10. The troffer body 16 further comprises end caps 17 connected to ends of the body. The troffer body 16 may be formed of metal, for example aluminum, and may be painted at least internally with a reflective white paint or may be polished to a highly reflective mirror like finish. A lower edge of the troffer body 16 defines an opening for light output. The opening in the lower portion of the troffer housing 16 is clearly shown in FIG. 4. The lamp sockets 19 are positioned at opposite ends of the troffer housing 16. The lamps (not shown) used with the luminaire 10 are fluorescent tube lamps, such as T4, T5 or T8 lamps, for example. However, such should not be considered limiting as alternate lamps may be used. The exemplary lamps are available from various manufacturers including General Electric, Philips and Sylvania. The instant embodiment depicts two sockets 19, however various members of sockets may be utilized. The inside surface of the troffer body may be coated with a reflective surface coating or an internal reflector may be utilized. Within the troffer housing 16 various components may be positioned but are not shown. For example, an electronic ballast, electronic fusing, or emergency battery packs may be stored in the body 16.

Figure 5:
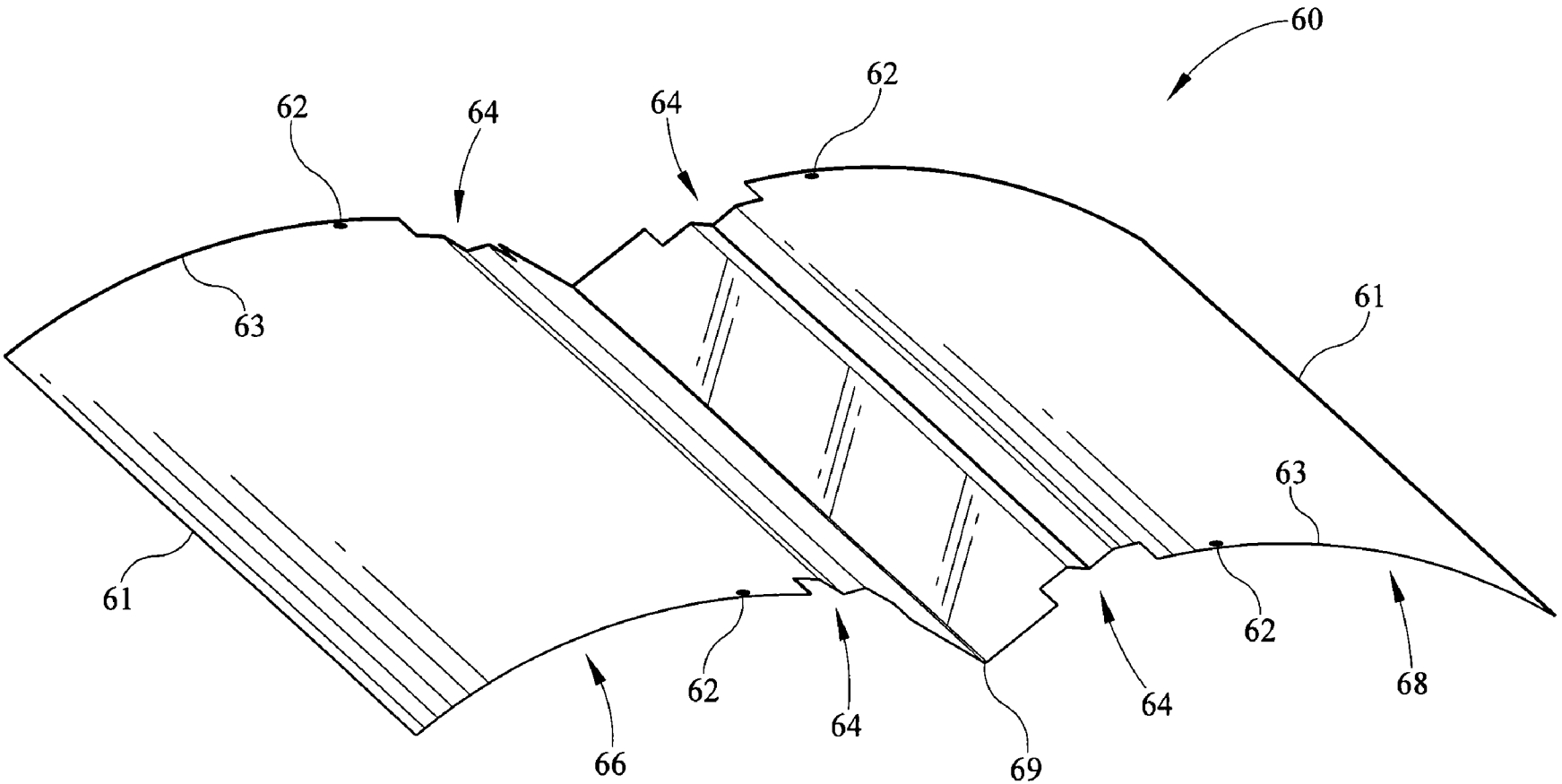
FIG. 5 depicts a rear reflector which may be optionally used with the fluorescent luminaire.

As shown in FIG. 5, a rear reflector 60 is depicted. The reflector 60 is optional for use within the luminaire 10 and may be formed of high purity aluminum or other metal with a polished mirrored surface, or may be coated plastic and may be diffused, such as by painting white, texturing or both. The reflector 60 is curvilinear wing-shaped, comprising twin parabolic curvilinear portions with notches 64 along two parallel edges. The notches 64 are cut out for the lamp sockets 19. The reflector 60 has a first substantially curvilinear portion 66 and a second substantially curvilinear portion 68 which are joined along a fold line 69. The reflector 60 is positioned with the troffer housing 16 adjacent the upper wall 18. The axis of the substantially curvilinear portion 66, 68 are parallel to the direction of a lamp extending between the sockets 19. The reflector 60, when positioned in the troffer housing 16, extends between the portions of the upper wall 18, so that the notches 64 are aligned with the sockets 19. The curvature of the reflector 60 provides that the reflector ends are closer to the lens 20. This has the result of providing substantially even lighting across the lens 20. With or without the reflector 60, the photometric performance of the luminaire assembly 10 is desirable for use.

The reflector 60 further comprises fastening apertures 62 along the latitudinal edges of the reflector wings 66, 68. The fastening apertures 62 attach to the troffer body or housing 16 if the optional reflector 60 is utilized. The reflector 60 comprises two longitudinal edges 61 and two latitudinal edges 63 which define the bounds of the reflector 60. A center fold line 69 extends in a longitudinal direction through the center of the reflector 60 and separates the first and second portion 66, 68.

Figure 6:
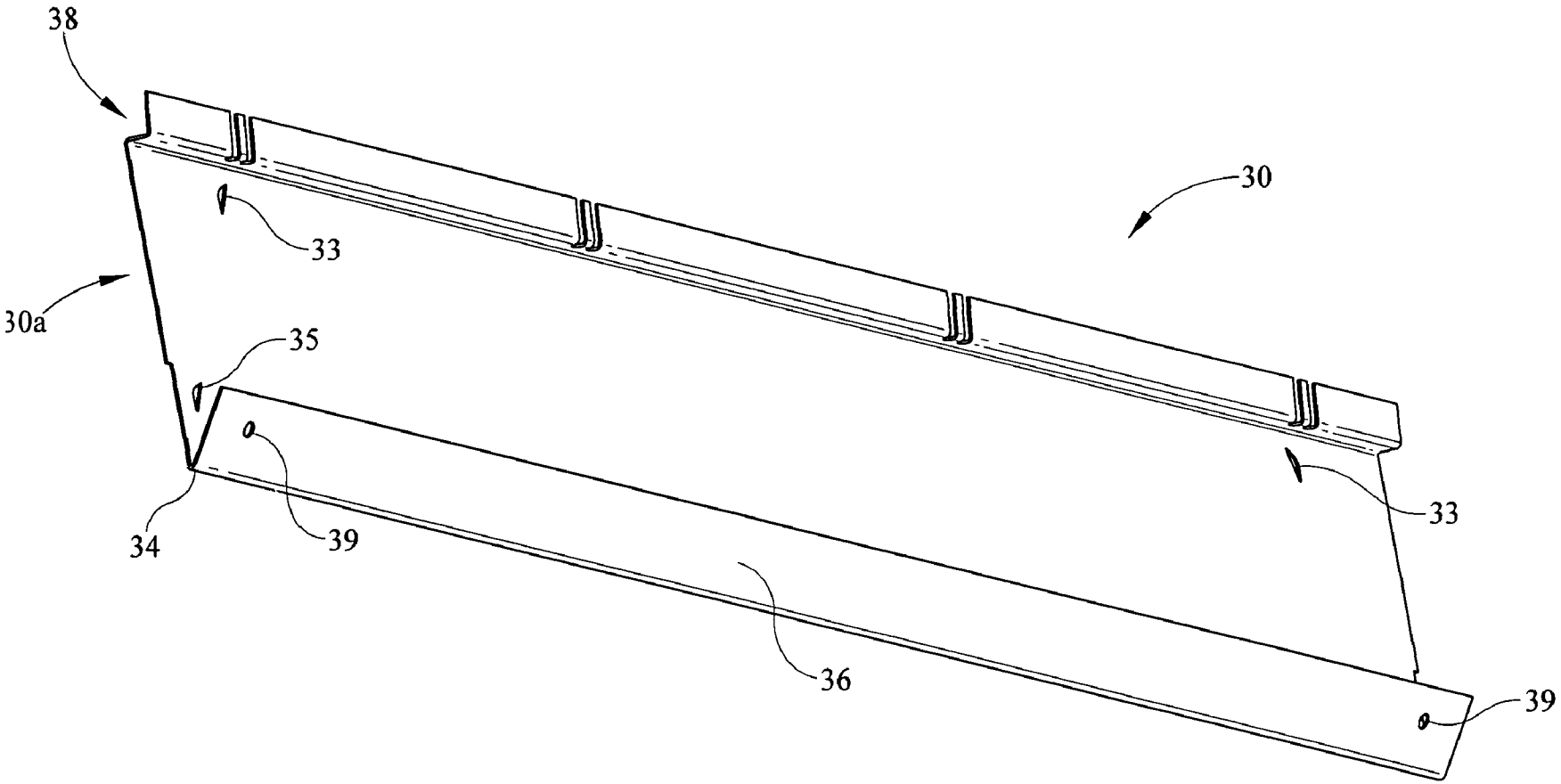
FIG. 6 depicts a perspective view of a side frame.
Figure 7:
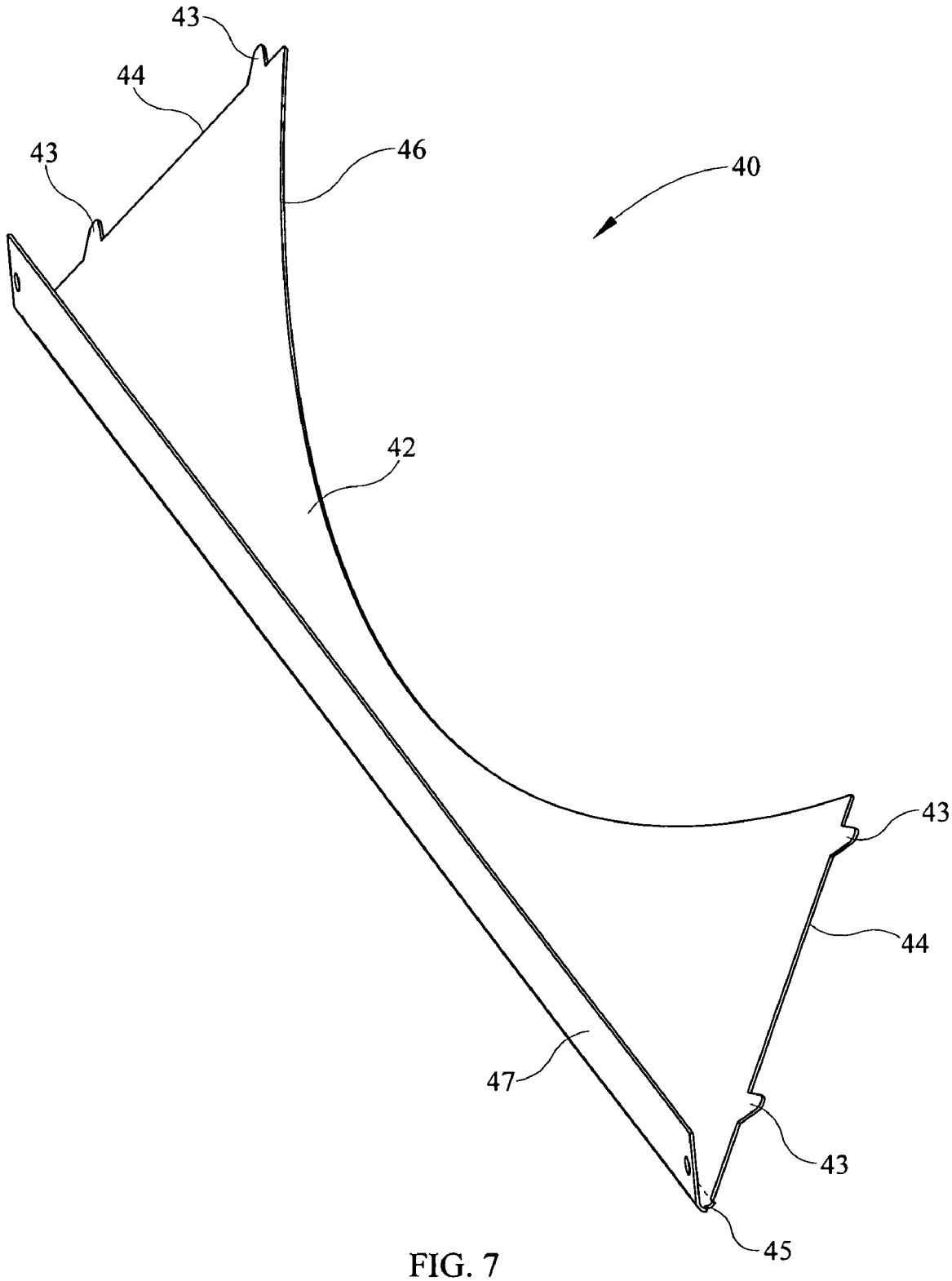
FIG. 7 depicts a rear perspective view of an end frame.

Referring now to FIG. 6, one of the side frame members 30 is depicted in perspective view. The side frame members 30, 32 are utilized to form the lens frame 70. The side frame member 30 is defined by a planar wall 30*a*. The lower edge of the wall is defined by a bend line 34 from which a leg 36 extends. At ends of the wall are first and second upper slots 33 and first and second lower slots 35. The slots 33, 35 receive tabs 43 extending from adjacent end frame members 40 (FIG. 7). The slots 33, 35 are aligned at an angle from the vertical rear ends of the side frame members 30, 32. Along the upper edge of the wall 30*a* a shoulder 38 is defined wherein the lens 20 is seated. The shoulder 38 is generally L-shaped, so that the lens 20 is seated within the inside corner of the shoulder 38. As previously described, the member 30 is positioned at an angle form the vertical. This positions the upper leg of the L at a position which is substantially perpendicular to the lens 20 inhibiting the lens 20 from inadvertently disengaging the shoulder 38. Alternatively stated, the shoulders 38 capture the lens 20. Along the leg 36, apertures 39 are spaced at ends so that the side members 30 and end members 40 may be clipped together to maintain a tight connection at lowermost ends of the frame members 30, 40.

Referring now to FIG. 7, the end frame member 40 is depicted in perspective view. The end frame comprises a planar wall 42 defined by end edges, a lower bend line 45 and an upper curvilinear edge 46. The bend line 45 defines an attachment location for a lower leg 47, which extends between the edges 44 of the end member 40. Extending from the edges 44 are upper and lower tabs 43 which correspond to the slots 33, 35 of the side members 30. The tabs 43 extend through the upper and lower slots 33, 35 and may be folded or crimped in order to retain the side members 30, 32 to the end members 40, 42. In addition, the leg 47 includes fastening apertures 48 similar to the apertures 39, which are utilized to connect the lower corners of the side members 30, 32 and end members 40, 42. The lens frame 70 is defined by the pair of end members 40 and pair of side members 30, wherein the lens 20 may be seated. The frame 70 is positioned within the troffer housing 16 using a method of hinge and latch devices.

Figure 8:
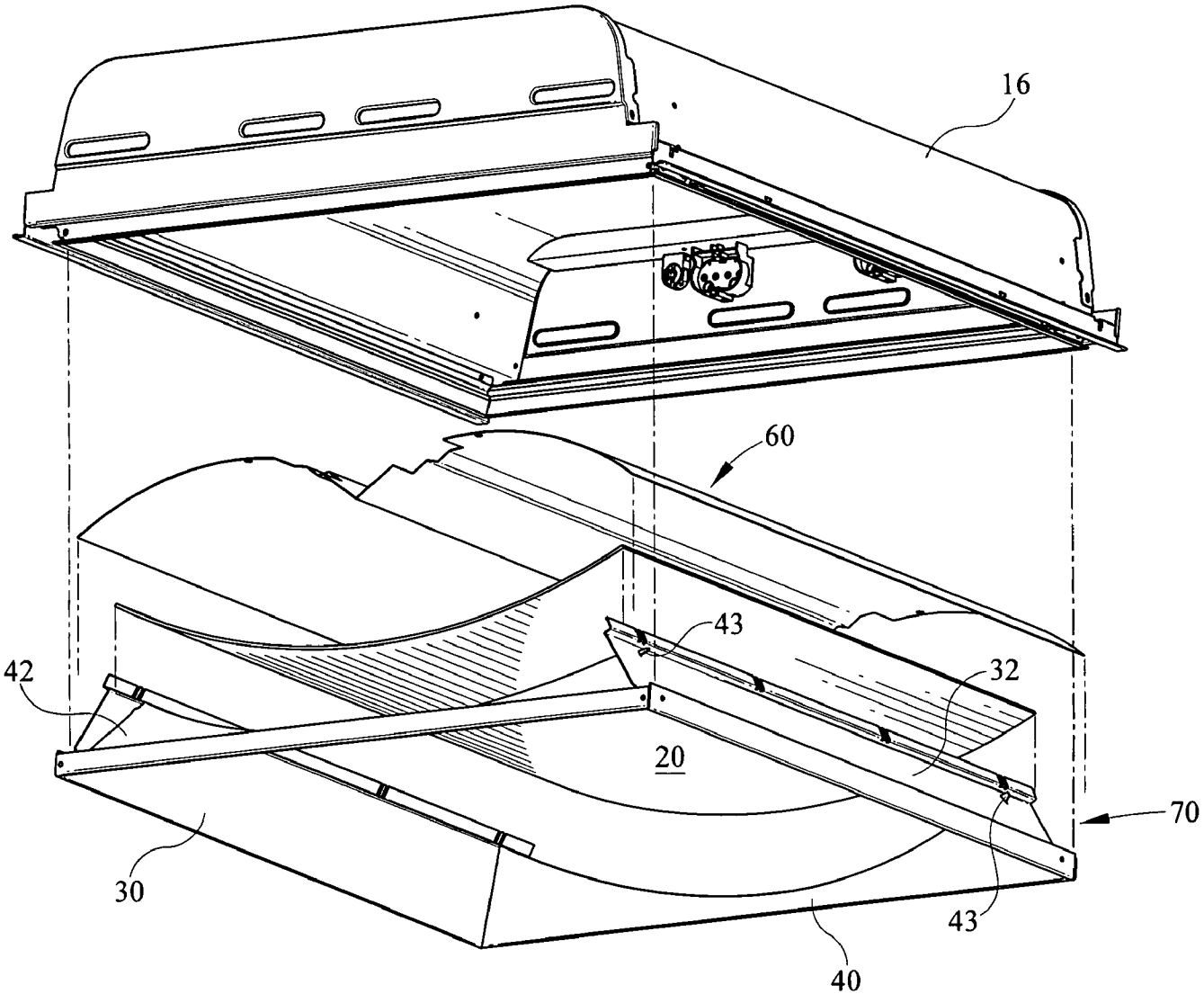
FIG. 8 depicts an exploded perspective view of the luminaire including a lens frame.

Referring now to FIG. 8, an exploded perspective view of the reflector 60 and frame 70 is depicted. The side members 30, 32 and end members 40, 42 are assembled to define the frame 70. The lens 20 is seated within the curved portion of the end members 40, and extends from one side member 30 to the opposite side member 30. Specifically, a horizontal dimension between the shoulders 38 is less than the non-flexed horizontal length, lens 20. As a result of the flexibility of the lens 20, the lens 20 bends and conforms to the curved edge 46 of the end frame members 40, 42. The lens 20 is captured between the shoulders 38 so that the lens 20 is captured between the shoulders 38 inhibiting the lens 20 from inadvertently dislodging from the frame 70.

Figure 9:
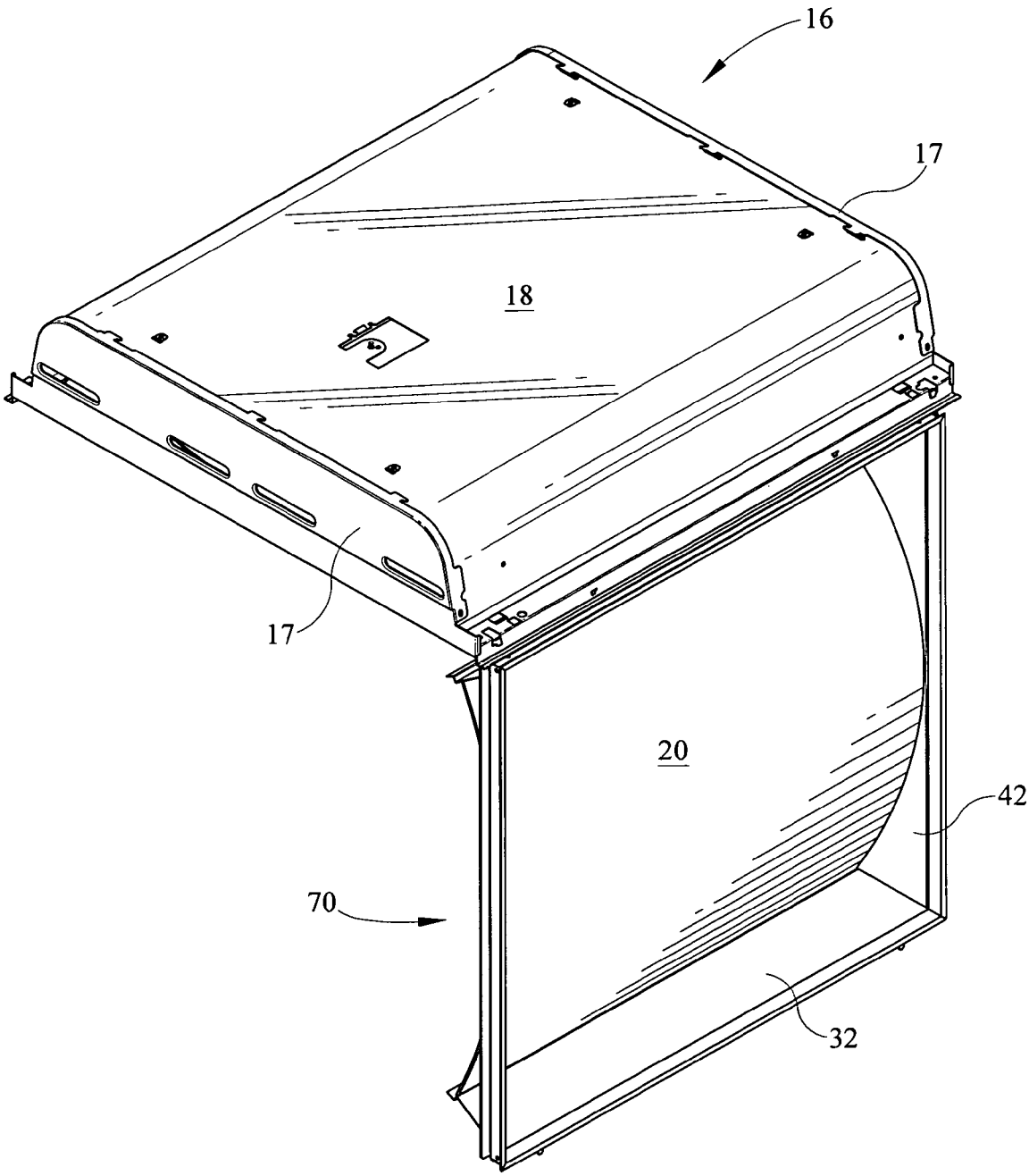
FIG. 9 depicts a perspective view of the frame pivoted downwardly from the housing.

Referring now to FIGS. 9-12, various views of the pivoting lens frame 70 are depicted with respect to the troffer housing 16. Referring first to FIG. 9, the housing 16 is depicted in perspective view. Along a lower edge of the housing 16, extending between the end cap, 17, a hinge 90 (FIG. 12) is defined to which the lens frame 70, including the lens 20 therein, are connected. The hinge mechanism 90 allows the lens 20 and frame 70 to pivot downwardly from and upwardly to the housing 16. This allows access to the lamps within the housing 16 as well as the electronic ballast and other electrical components, which may need periodic maintenance or replacing.

Figure 10:
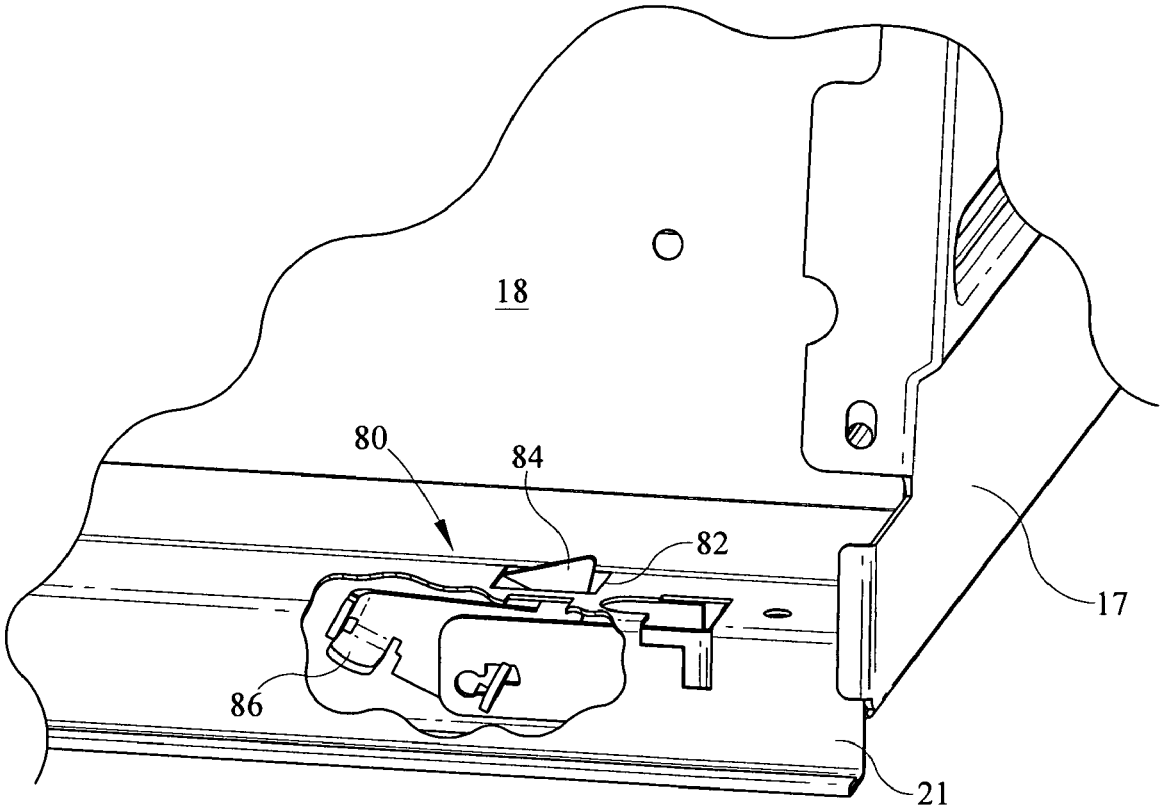
FIG. 10 depicts a detail perspective view of the latching mechanism in an opening position.

Referring now to FIG. 10, a detail perspective view of a corner of the luminaire 10 is depicted where the end cap 17 meets the upper wall 18. The upper wall 18 has a Z-shaped leg 21 extending along a lower edge of the wall between the end caps 17. Although the leg is Z-shaped, alternate structural shapes may be used and therefore such should not be limiting. In the Figure depicted, a portion of the leg 21 is cut away to depict a latching mechanism 80. An upper surface of the leg 21 includes an aperture 82. A latch 84 extends through the aperture when the lens frame 70 is in the full upright position for operation. As depicted in FIG. 10, the latch 84 is pivoted into the aperture 82, so as to enable the latch to pass through the aperture 82 and so that the lens frame 70, including lens 20, may move downwardly, opening the interior portion of the housing 16. Connected to the latch 84 is a latch pull 86. The latch pull 86 and latch 84 are pivotally connected to some internal structure, so that the latch 84 pivots and extends over an edge of the aperture 82 when the frame 70 is in the fully upright position. Alternatively, the pull 86 may be forced upwardly causing the latch 84 to pivot into the aperture 82 as previously described. The latch mechanism 80 may be spring biased to a normally closed position or may be actuated manually in one or both directions.

Figure 11:
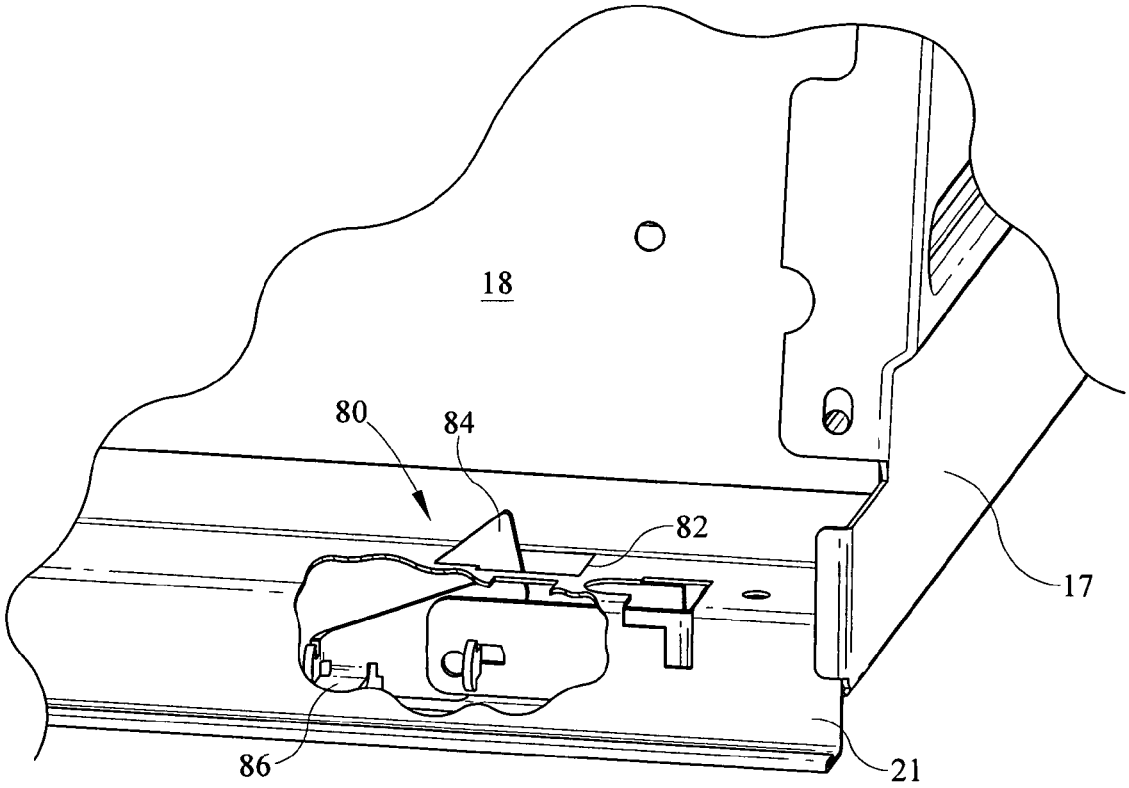
FIG. 11 depicts a detail perspective view of the latching mechanism in a closed position.

Referring now to FIG. 11, the latch mechanism 80 is shown in the upright position and locked corresponding to the lens frame 70 being in the closed position. As indicated in FIG. 11, the latch 84 extends over an edge of the aperture 82, so that the lens frame 70 cannot move downwardly through the aperture 82. Once the latch pull 86 is pushed upwardly, the latch 84 pivots into the aperture 82 and is clear of the edge of aperture 82 as depicted in FIG. 10.

Figure 12:
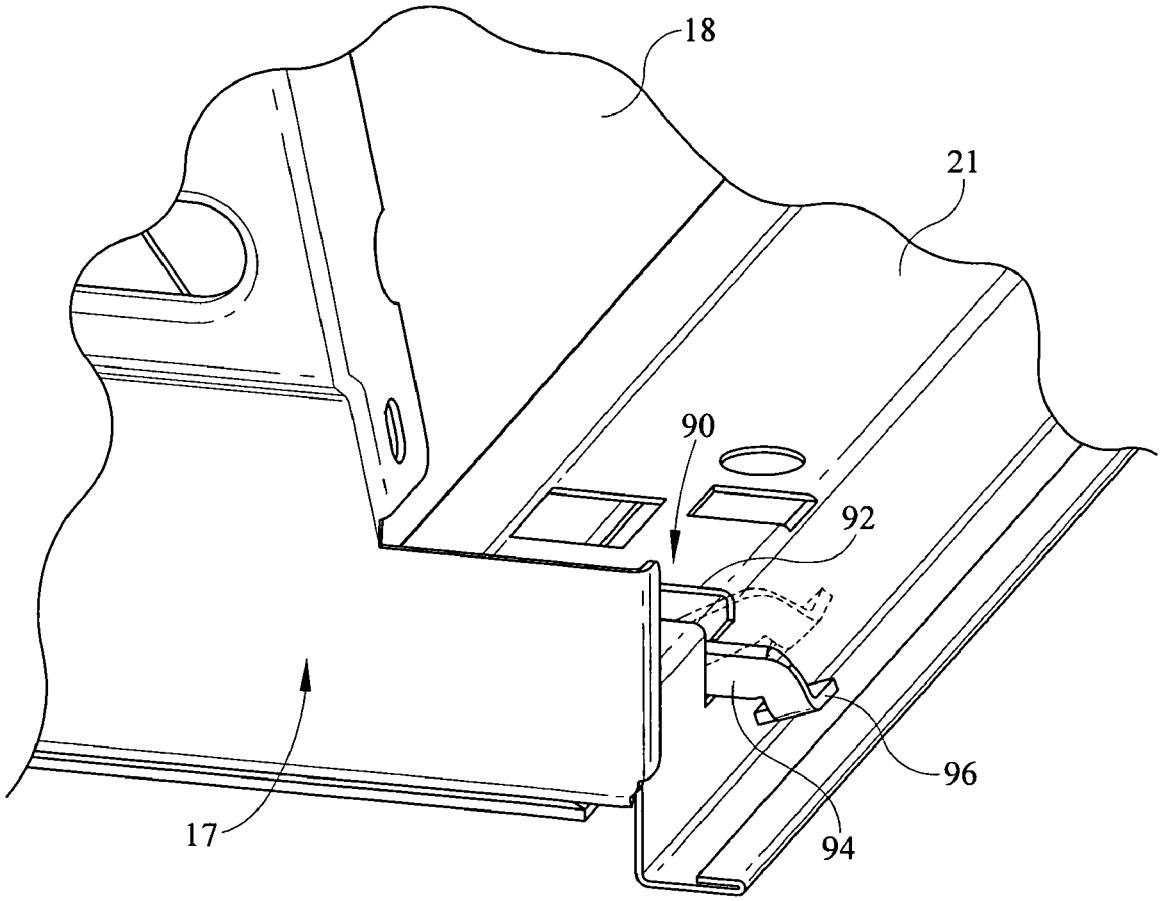
FIG. 12 depicts a detail perspective view of the hinge mechanism in a closed position and moving toward an open position; and, FIG. 13 depicts a flow chart describing methods of assembly for the luminaire.

Referring now to FIG. 12, the opposite side of the housing 16 and upper wall 18 are depicted. As with the first side, previously described with respect to FIGS. 10 and 11, a leg 21 extends from the upper wall 18 between the end caps 17. Along this side of the housing 16, the leg 21 defines an area for the hinge mechanism 90. Thus, on one side of the luminaire 10 is at least one latch assembly 80 and on the opposite side of the luminaire, is a hinge assembly 90. The hinge mechanism 90 includes a pivot aperture 92, and a pivot leg 94 having a catch 96 at an end of the leg 94. The leg 94 is connected to the lens frame 70 (not shown) so that as the lens frame 70 moves from the closed position to the open position, the pivot leg 94 and catch 96 move from the position shown in solid line to the position shown in broken line. When the lens frame 70 is in a downward position, as shown in FIG. 9, the catch 96 engages an edge of the pivot aperture 92, so that the lens frame cannot fall from the leg 21. Thus, the latching mechanism 80 and the pivot mechanism 90 allow opening and closing of the lens frame 70 to access the interior portion of the luminaire 10, and allow for locking of the lens frame in an upward position during operation once maintenance inside the luminaire 10 is completed.

Figure 13:
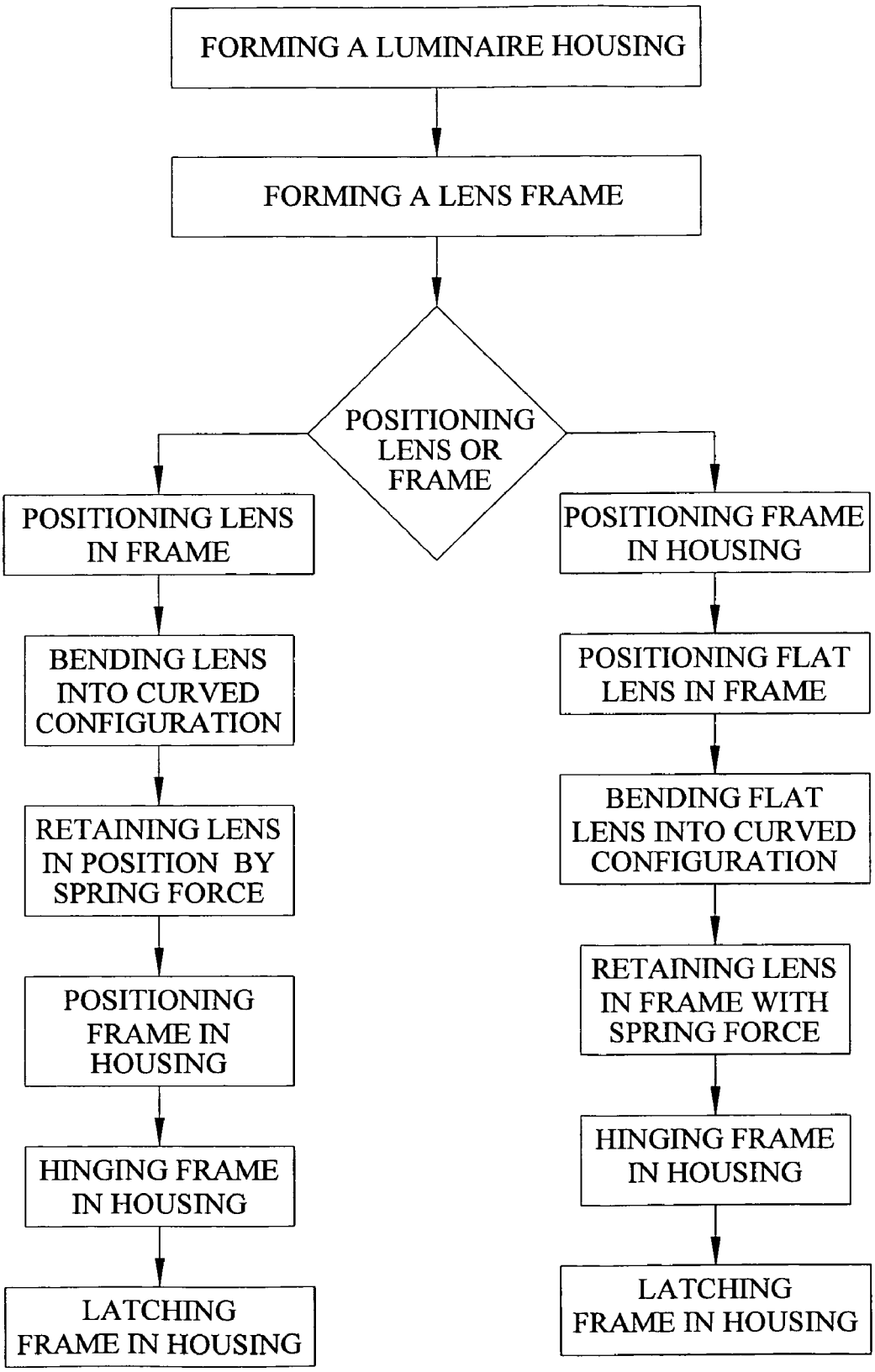

With reference now to FIG. 13, in manufacturing, the luminaire housing 16 is formed and positioned to receive the lens frame 70. Next, the lens frame 70 is formed, and the lens frame 70 is positioned within the luminaire housing 16. After the lens frame is positioned within the luminaire housing, a flat lens is positioned within the lens frame. The flat lens is positioned by bending the flat lens into a curved configuration, wherein the frame retains the lens in this curved configuration. Alternatively, the flat lens may be positioned in the lens frame prior to positioning of the lens frame within the luminaire housing. In either event, the bending of the flat lens creates a spring force, which retains the lens in position in the lens frame. As previously described, the lens frame 70 may be hingedly positioned within the luminaire housing 16 in order to allow opening and closing of the luminaire by lowering of the lens frame 70 and luminaire housing. The lens frame 70 may also be latched in a closed position within the luminaire housing.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

What is claimed is:

1. A luminaire, comprising:

a luminaire housing;

a lens frame positioned within said luminaire housing;

said lens frame having a first side frame member and a second side frame member connected to a first end frame member and a second end frame member;

a flexible plastic lens having a length;

wherein a distance between said first and second side frames is less than said length of said plastic lens; and, wherein said lens curves from said flat orientation to a curved orientation when seated between said first and second side frames corresponding to curvature of said first and second end frames.

2. The luminaire of claim 1, said first end frame member and said second end frame member each having a curved upper edge.

3. The luminaire of claim 2, said lens being positioned against said curved edges of said first and second end frame members.

4. The luminaire of claim 3, said first and second side frame members having a shoulder wherein said lens is seated.

5. The luminaire of claim 1, said lens being convex curved.

6. The luminaire of claim 1 wherein said lens is seated within said lens frame and extends from a first end of said luminaire to a second end of said luminaire and from a first side to a second side.

7. The luminaire of claim 1 wherein said first and second end frame members are disposed at an angle from the vertical.

8. The luminaire of claim 1 wherein said first and second side frame members are disposed at an angle from the vertical.

9. The luminaire of claim 1, said side members having shoulders along an edge.

10. The luminaire of claim 9, said side members being angled.

11. The luminaire of claim 10 wherein an upper portion of said shoulders captures said lens.

12. The luminaire, comprising:

a luminaire housing having preselected opening shape;

a first side frame member and an opposed side frame member connected to a first end frame member and a second end frame member, said side frame members and said end frame members defining a lens frame within said housing;

each of said end frame members having a curved upper edge and a lens seated therein, said lens extending between said side frame members and said end frame members; and, wherein said lens is flat and flexibly seated within said curved portion to conform to the curvature of said curved portion.

13. The luminaire of claim 12 wherein said end frame members are disposed at an angle.

14. The luminaire of claim 12 wherein said side frame members are disposed at an angle.

15. The luminaire of claim 12 further comprising a bar extending along an edge of said luminaire body.

16. The luminaire of claim 12, said end frame members further comprising a leg portion along a lower edge of said end body members.

17. The luminaire of claim 16, said side frame members having slots for receiving tabs extending from said end body members.

18. The luminaire of claim 17 further comprising a leg along a lower edges of said side frame members and said end frame members.

19. The luminaire of claim 12 wherein said body has a lower opening and said lens has a convex curvature.

20. The luminaire of claim 12 wherein one of said first and second side frame members and said first and second end frame members has a shoulder for seating opposed edges of said lens and maintaining a curvature of said lens.

21. A luminaire, comprising:

a housing having opposed ends, opposed sides, an upper wall and a lower opening;

opposed side members disposed within said housing adjacent said opposed sides;

opposed end members connected to said opposed side members;

said opposed end members having a curved edge; and, wherein a lens extends between said opposed side members and is seated against said curved edge.

22. The luminaire of claim 21 wherein said lens is formed of a flexible material.

23. The luminaire of claim 21 has a convex curvature.

24. The luminaire of claim 21 further comprising a rear reflector within said housing and above said lens.

25. The luminaire of claim 21 wherein said housing is positioned in a suspended ceiling structure.

26. The luminaire of claim 25, said suspended ceiling structure formed of inverted T-grid members extending longitudinally and latitudinally.

27. The luminaire of claim 21, said opposed side members and said opposed end members defining a lens frame.

28. The luminaire of claim 27, said lens frame being hingedly connected to said housing.

* * * * *